United States Patent [19]

Doody

[11] 3,969,907

[45] July 20, 1976

[54] COLD CYLINDER ASSEMBLY FOR CRYOGENIC REFRIGERATOR

[75] Inventor: Richard D. Doody, Culver City, Calif.

[73] Assignee: The United States of America as represented by the Secretary of the Air Force, Washington, D.C.

[22] Filed: Mar. 25, 1975

[21] Appl. No.: 561,767

[52] U.S. Cl. ..... 62/6

[51] Int. Cl.[2] ..... F25B 9/00

[58] Field of Search ..... 62/6

[56] References Cited

UNITED STATES PATENTS

| | | | |
|---|---|---|---|
| 3,650,118 | 3/1972 | O'Neil | 62/6 |
| 3,717,004 | 2/1973 | O'Neil | 62/6 |
| 3,802,211 | 4/1974 | Bamberg et al | 62/6 |
| 3,906,739 | 9/1975 | Raimondi | 62/6 |

*Primary Examiner*—Lloyd L. King

*Attorney, Agent, or Firm*—Joseph E. Rusz; Richard J. Killoren

[57] ABSTRACT

The cold cylinder assembly for a two stage Vuilleumier cycle cryogenic refrigerator having an outer cylinder forming a first chamber of a large diameter and a second chamber of a smaller diameter with a cold displacer within the cylinder. The cold displacer includes a first stage regenerator and a second stage regenerator. Gas from the crankcase passes through channels in the rider ring and then through ports to an annular passage within the cold displacer and then to the first stage regenerator. Gas from the first stage regenerator divides into two parts with one part passing to the second stage regenerator and then through passages to ports to impinge on an end member for the second stage heat load. The other part flows through passages to ports to impinge upon an end wall for the first stage heat load.

3 Claims, 5 Drawing Figures

COLD CYLINDER ASSEMBLY FOR CRYOGENIC REFRIGERATOR

RIGHTS OF THE GOVERNMENT

The invention described herein may be manufactured and used by or for the Government of the United States for all governmental purposes without the payment of any royalty.

BACKGROUND OF THE INVENTION

This invention relates to a cold cylinder assembly for use in a cryogenic refrigerator of the type described in the U.S. Pat. to Vuilleumier, No. 1,275,507.

In prior art, Vuilleumier cycle two stage cryogenic refrigerators, the heat load is absorbed by the gas in an annular heat exchanger formed between the cold cylinder and the cold displacer. In these devices, the gas to the second stage passes through the first stage and requires two right angle turns of the gas adjacent the first stage expansion volume. The radial clearance in the annulus is small, for example, 0.005 inch. The small flow area with the two right angle bends causes a pressure loss. There is also a lower thermal efficiency due to the presence of stagnant gas pockets.

BRIEF SUMMARY OF THE INVENTION

According to this invention, gas from the crankcase enters slots in the rider and then flows through ports into an annulus near the warm end of the first stage regenerator. Gas at the output of the first stage regenerator separates into two parts. One part of the gas flow proceeds to the second regenerator and the other part passes through a manifold to a plurality of ports to impinge upon the end cap of the first stage expansion volume where the first stage heat load is absorbed.

The gas passing through the second stage regenerator is collected in a second manifold and directed through ports to the heat station of the second stage expansion volume.

IN THE DRAWINGS

DETAILED DESCRIPTION OF THE INVENTION

Figure 1:
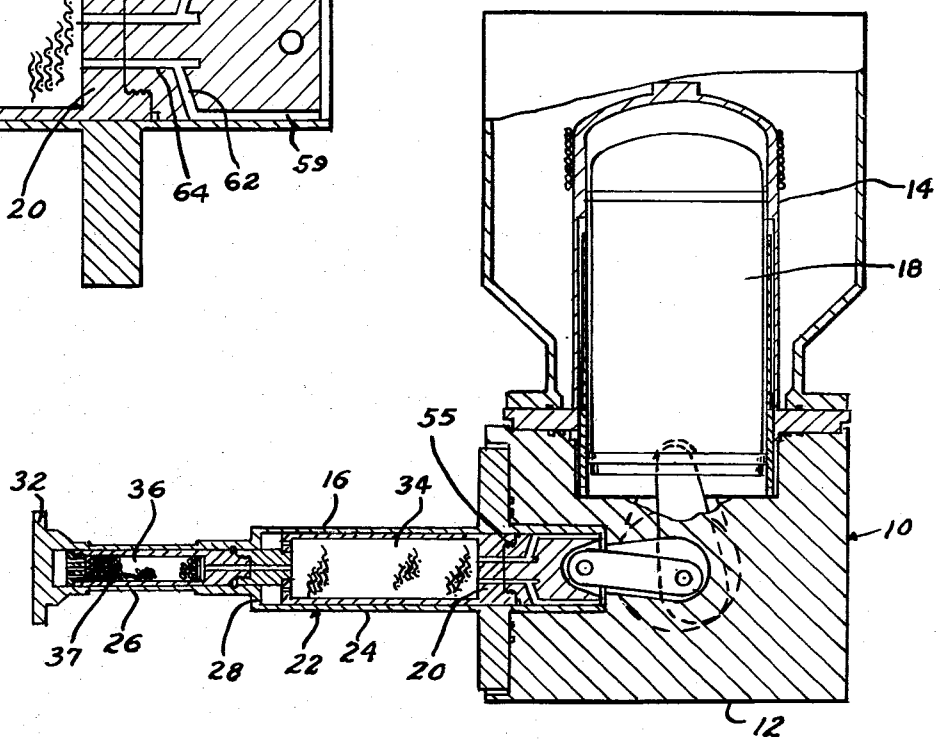
FIG. 1 is a partially schematic sectional view of a two-stage Vuilleumier cycle cryogenic refrigerator using the cold cylinder assembly of the invention.
Figure 2:
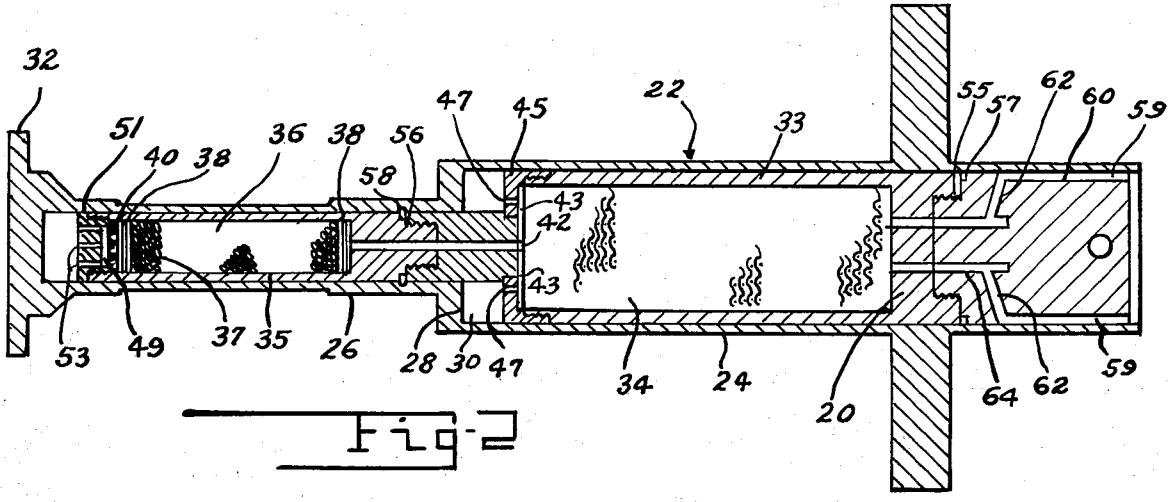
FIG. 2 is an enlarged partially schematic sectional view of the cold cylinder assembly of the device of FIG. 1.
Figure 3:
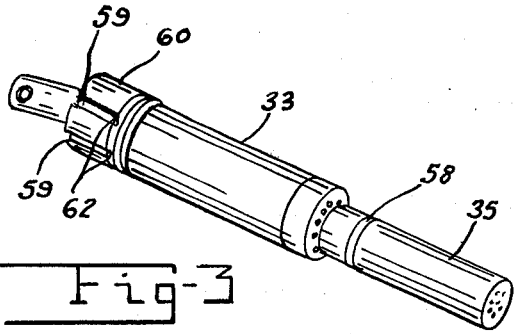
FIG. 3 is an isometric view of the cold displacer for the device of FIG. 2.

Reference is now made to FIG. 1 of the drawing which shows a two stage Vuilleumier cycle cryogenic refrigerator 10 having a crankcase 12, a hot cylinder assembly 14, and a cold cylinder assembly 16. The displacers 18 and 20 in the hot and cold cylinder assemblies are driven in a conventional manner by a motor, not shown.

The cold cylinder assembly has an outer cylinder 22 having a first portion 24 of a larger diameter than a second portion 26. The two portions are interconnected by a radial wall 28 which forms the end wall for the first stage cold volume 30 and which acts as the heat exchange member for the first stage heat load. The second portion 26 is closed by an end member 32 which acts as the heat exchange member for the second stage heat load.

The displacer 20 has a first portion 33 enclosing a first stage regenerator 34 and a second portion 35 enclosing a second stage regenerator 36. In one device constructed, the first stage regenerator contained 400 mesh stainless steel screen. The second stage regenerator contained 0.003 inch lead spheres 37 held at each end by 400 mesh stainless steel screen 38. A wavy spring washer 40 is provided to keep the lead sphere packing in position.

The gas leaving the first stage regenerator is divided into two parts, with one part flowing through passage 42 to the second stage regenerator and the other part passing through the passages 43, in the first stage manifold 45, to ports 47. The gas leaving the ports 47 impinges upon the wall 28.

Figure 4:
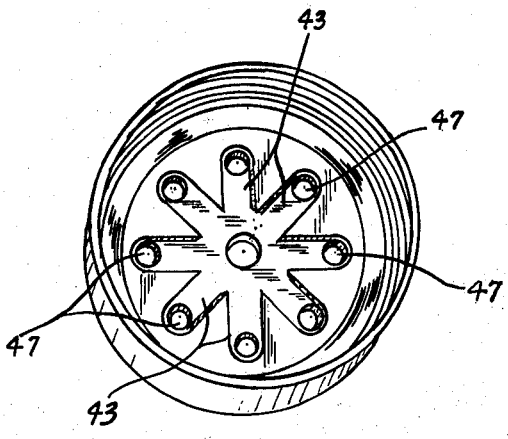
FIG. 4 is an isometric inside view of the first stage manifold element for the device of FIG. 2.
Figure 5:
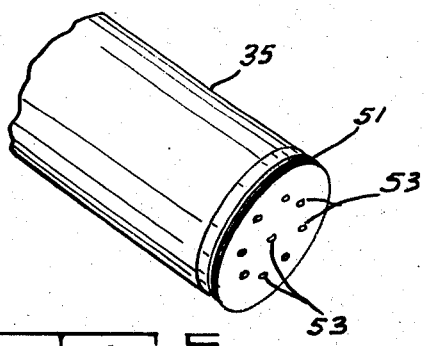
FIG. 5 is an isometric view of the second stage manifold element for the device of FIG. 2.

The gas flowing through passage 42 enters the second stage regenerator 36. The gas leaving the second stage regenerator flows through passages 49 in the second stage manifold 51 to ports 53. The passages 49 are similar to passages 43, shown in FIG. 4. The gas leaving the ports 53 impinges upon the end member 32. Heat transfer coefficients are greater for impingement flow compared to channel flow.

The cold displacer is made so that it can be separated at 55 and 56 to permit the installation of the seals 57 and 58.

In the operation of the device, movement of the cold displacer toward the crankcase causes the gas to flow through slots 59 in the rider ring 60 and then pass through ports 62 to the annular passage 64. The gas leaving the passage 64 passes through the first stage regenerator 34 and then divides into two parts with one part flowing through passage 42 through the second stage regenerator 36 and then through manifold passages 49 and ports 53 to impinge upon end member 32. The second part of the gas leaving the first stage regenerator passes through passages 43, through ports 47 to impinge upon the wall 28. Movement of the displacer away from the crankcase reverses this flow.

In the use of the device, infrared detectors may be mounted on a beryllium heat sink which is directly connected to end member 32. The first stage may be used to aid in cryopumping the vacuum dewar which normally encloses the detectors and cold finger of the refrigerator system.

There is thus provided a cold cylinder assembly for a two stage Vuilleumier cycle cryogenic refrigerator which reduces pressure losses and wherein the gas flow to the second stage does not pass through the first stage cold volume and which provides more efficient heat transfer with the use of impingement flow.

I claim:

1. In a two-stage Vuilleumier cycle cryogenic refrigerator system; a cold cylinder assembly, comprising: an outer cylindrical member having a first portion, with a large diameter and a second portion, with a smaller diameter; a radial wall member interconnecting the large diameter portion of the cylindrical member to the smaller diameter portion, and forming the end wall for a first expansion volume adapted to be connected to a first heat load; an end member closing the smaller portion of said outer cylindrical member; said end member being adapted to be connected to a second heat load; a displacer member within said outer cylindrical member; said displacer having a first portion of a larger diameter adapted for movement within the larger diameter portion of the outer cylindrical member and a second portion of a smaller diameter adapted for movement within the smaller diameter portion of the outer cylindrical member; a first regenerator in the first portion of said displacer; a second regenerator in the second portion of said displacer; means for providing a gas flow path into said first regenerator; means, in said displacer between the first regenerator and the second regenerator for providing a first gas flow path to said second regenerator and a second gas flow path for impingement on said radial wall member; means adjacent the end of said second regenerator for providing a gas flow for impingement on the end member closing the smaller portion of the outer cylindrical member

2. The device as recited in claim 1 wherein said means for providing a first flow path to the second regenerator and a second flow path for impingement on said radial wall member comprises: a manifold member having means for providing a flow path between the first regenerator and the second regenerator and a plurality of flow ports adjacent said radial wall with a plurality of gas flow channels for supplying gas flow to said gas flow ports and said means for providing a gas flow for impingement on the end member closing the smaller portion of the outer cylindrical member being a manifold member having a plurality of flow ports with a plurality of gas flow channels for supplying gas flow to said gas flow ports.

3. The device as recited in claim 2 wherein said means for providing a gas flow path into said first regenerator includes a rider ring on the first portion of said displacer with a plurality of passages for gas flow; an annular passage adjacent the end of said first regenerator and a plurality of gas flow ports between the passages in the rider ring and said annular passage.

* * * * *